US008132347B2

(12) United States Patent
Oliver-Collins et al.

(10) Patent No.: US 8,132,347 B2
(45) Date of Patent: Mar. 13, 2012

(54) INTERCHANGEABLE LABEL HOLDER

(75) Inventors: Danell M. Oliver-Collins, Kansas City, KS (US); Brian Russell Palmer, Kansas City, MO (US); Craig William Cayce, Kansas City, MO (US); Derek Lai Keung Pong, Ma On Shan (HK)

(73) Assignee: Hallmark Cards, Incorporated, Kansas City, MO (US)

( * ) Notice: Subject to any disclaimer, the term of this patent is extended or adjusted under 35 U.S.C. 154(b) by 167 days.

(21) Appl. No.: 12/769,447

(22) Filed: Apr. 28, 2010

(65) Prior Publication Data

US 2011/0265363 A1 Nov. 3, 2011

(51) Int. Cl.
*G09F 3/00* (2006.01)

(52) U.S. Cl. ..... 40/642.01; 211/57.1; 248/221.12; 248/222.41

(58) Field of Classification Search ..... 40/661.05, 40/657, 642.01; 211/57.1, 59.1; 248/220.2, 248/221.12, 222.41
See application file for complete search history.

(56) References Cited

U.S. PATENT DOCUMENTS

| | | | | |
|---|---|---|---|---|
| 5,002,249 | A * | 3/1991 | Meyer | 248/316.7 |
| 6,389,722 | B1 * | 5/2002 | Josefsson et al. | 40/642.01 |
| 7,513,074 | B2 * | 4/2009 | Glenn et al. | 40/649 |
| 7,909,183 | B2 * | 3/2011 | Oh | 211/59.1 |
| 2001/0005953 | A1 * | 7/2001 | Painsith | 40/750 |

OTHER PUBLICATIONS

Trion Elements of Merchandising, New 2008 Catalog, Holding the Line on Prices, Fixture Handbook, undated, cover page, pp. 2, 14-17 and 21.
FFR-DSI, Product Details, Flip Data Strip Label Holder for T-Scan Hook and DS-MSP Data Strip Label Holder for Metal Scan Plate, www.ffr-ds.com.
Southern Imperial, Inc., Display Results, Hold, Support. Brand. Display. Impulse, Sell, 2010 Display & Fixture Solutions Guide, Label Holders, cover page, pp. 72-73.
Food Retailing Edition, 2009 FFR-DSI Yellow Pages Catalog, Product Merchandising—Data Strip Label Holder, p. 434, dated 2009.

* cited by examiner

*Primary Examiner* — Joanne Silbermann
*Assistant Examiner* — Shin Kim
(74) *Attorney, Agent, or Firm* — Shook, Hardy & Bacon L.L.P.

(57) ABSTRACT

When displaying products on a display hook, labels associated with the products are oftentimes presented via a label holder affixed to the display hook. Because various display hook structures exist, an interchangeable label holder can be utilized to adjoin to the various structures. Accordingly, in one embodiment, a label holder is adapted for being affixed to both a cylindrical-shaped crossbar and a display plate crossbar of a display hook. The rear face of the interchangeable label holder includes first brackets and second brackets adapted for receiving either the cylindrical-shaped crossbar or the display plate crossbar. The rear face of the interchangeable label holder also includes a first securing element and a second securing element functional for receiving lateral edges of the display plate crossbar to restrict lateral movement of the label holder. The front face includes an edge extending substantially perpendicular from the face with a plurality of label securing elements extending inwardly to retain a label in the label holder.

20 Claims, 5 Drawing Sheets

INTERCHANGEABLE LABEL HOLDER

SUMMARY

When displaying products on a display hook, product labels associated with the products are oftentimes presented via a label holder that is affixed to the front of the display hook. While the labels can be secured to the display hook directly, label holders are often preferred based on appearance and ease of use. Various structures of display hooks exist including, for example, display hooks having cylindrical crossbars and display hooks having display plates to which label holders are secured. Accordingly, existing label holders are designed for use with a particular type of display hook. For example, assume a particular label holder is configured to accommodate a particular type of display hook, such as a display hook with a cylindrical crossbar. In such a case, the label holder is generally not adaptable to adjoin to another type of display hook, such as a display hook with a display plate. In this regard, label holders specific to each type of display hook (e.g., display plate bar display hooks and cylindrical-crossbar display hooks) are required. Requiring a specific label holder for each type of display hook can be costly, time consuming, and inefficient.

In one embodiment of the present invention, a restricted lateral-movement label holder is provided. The label holder is affixable to a display hook having either a cylindrical-shaped crossbar or a display plate located at a distal end of a cantilevered prong called a label member. The label holder includes a substantially planar panel having a front face and a rear face, the front face adaptable for displaying a label. The label holder also includes a set of discontinuous brackets comprising a first bracket and a second bracket located above a horizontal mid-line of the label holder. The first bracket and the second bracket are adapted for receiving a cylindrical-shaped crossbar of a display hook, wherein a portion of the label member of the display hook is positioned between the first bracket and the second bracket and extends outwardly therefrom to restrict lateral movement of the label holder. Further, the label holder includes a set of securing elements comprising a first securing element and a second securing element perpendicularly oriented to the horizontal mid-line of the label holder functional for receiving lateral edges of a display plate of a display hook to restrict lateral movement of the label holder.

In yet another embodiment, a label holder for interchangeably adjoining to a display hook having a non-planar crossbar and a display hook having a display plate is provided. The label holder includes a substantially planar panel having a front face and a rear face, the front face adaptable for displaying a label. The label holder also includes a pair of brackets comprising a first bracket and a second bracket located above a horizontal mid-line of the label holder. The brackets are adapted for receiving either the non-planar crossbar or the display plate. The label holder further includes a pair of securing elements functional for receiving lateral edges of the display plate to restrict lateral movement of the label holder.

In still another embodiment, a label holder for displaying a label is provided. The label holder includes a substantially planar panel having a front face and a rear face. The front face has a front edge extending substantially perpendicular from the front face. The front edge has an inner perimeter. The label holder also includes a set of label securing elements dispersed along the inner perimeter of the front edge. Each of the label securing elements is substantially parallel with the substantially planar panel and extends inwardly from the front edge.

The set of label securing elements cooperate to releasably position a label adjacent the front face of the substantially planar panel. The label holder further includes a removal aperture sized to accommodate insertion of a label removing component through the removal aperture to remove the label.

BRIEF DESCRIPTION OF THE DRAWINGS

The features of embodiments of the invention noted above are explained in more detail with reference to the embodiments illustrated in the attached drawing figures, in which like reference numerals denote like elements, in which FIGS. 1-10 illustrate several possible embodiments of the present invention, and in which:

FIG. 1 is a rear perspective view of an exemplary label holder, in accordance with an embodiment of the present invention;

FIG. 2 is a front perspective view of a label holder having a label secured thereto, in accordance with an embodiment of the present invention;

FIG. 3 illustrates a view of a label holder approaching a cylindrical-crossbar display hook for fastening thereto;

FIG. 4 illustrates another view of a label holder approaching a cylindrical-crossbar display hook for fastening thereto;

FIG. 5 illustrates a label holder adjoined to a cylindrical-crossbar display hook, in accordance with an embodiment of the invention;

FIG. 6 illustrates a front perspective view of a label holder adjoined to a cylindrical-crossbar display hook, in accordance with an embodiment of the invention;

FIG. 7 illustrates a view of a label holder approaching a display plate display hook for fastening thereto;

FIG. 8 illustrates another view of a label holder approaching a display plate display hook for fastening thereto;

FIG. 9 illustrates a label holder adjoined to a planar-crossbar display hook, in accordance with an embodiment of the invention; and FIG. 10 illustrates a front perspective view of a label holder adjoined to a planar-crossbar display hook, in accordance with an embodiment of the invention.

DETAILED DESCRIPTION

Figure 1:
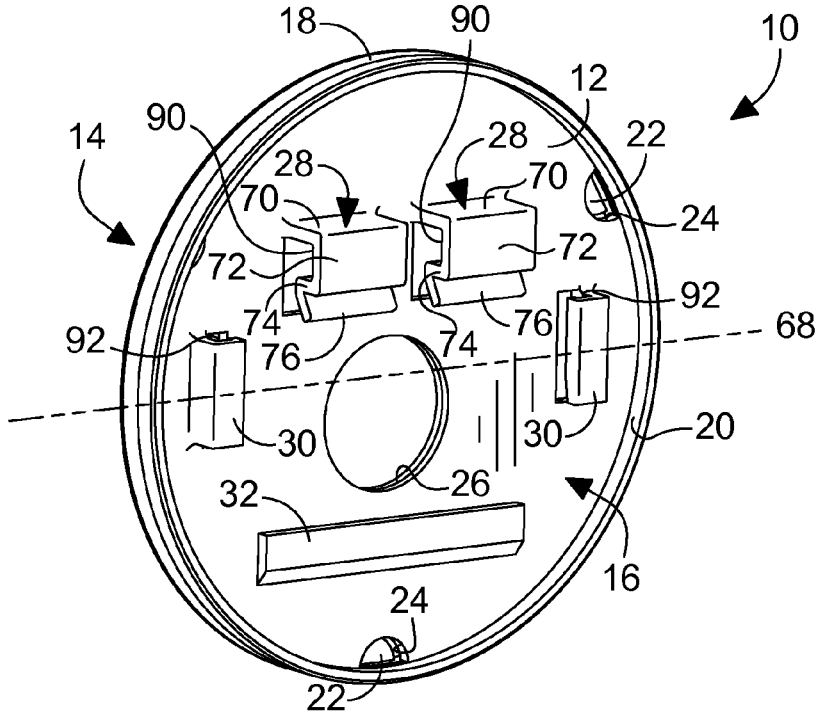

Referring now to the drawings in more detail and initially to FIG. 1, numeral 10 generally designates a label holder (i.e., an interchangeable label holder) constructed in accordance with an embodiment of the present invention. The label holder 10 enables a product label to be displayed in association with a hanging display of a product via a display hook. A product label, as used herein, refers to any label associated with or describing one or more products. A product label might include, for example, a price, a description, a bar code, a product name, and/or any other feature associated with one or more products being displayed.

The label holder 10 is configured to be coupled to a display hook that is used to display one or more products. Display hooks are used to display or hang various products therefrom. Products can be directly or indirectly (e.g., via a tag, string, etc.) attached to the display hooks. As discussed more fully below, the label holder 10 can be interchangeably attached to display hooks having either a cylindrical crossbar (i.e., a cylindrical-crossbar display hook) or a display hook having a display plate (i.e., a display plate display hook). In this regard, the label holder 10 is a convertible label holder configured to attach to and work with both a cylindrical-crossbar display hook and a display plate display hook. Although the label holder 10 is illustrated as circular in shape, the label holder can be any shape, such as, for example, rectangular, square, oval, octagon, etc.

In this illustrated example, the label holder 10 includes a panel 12 for supporting a label, such as a product label. Panel 12 is a substantially planar member. Panel 12 has a front face 14 and a rear face 16 substantially parallel to one another. As illustrated in FIG. 1, a front edge 18 positioned along the perimeter of panel 12 extends substantially perpendicular from the front face 14, and a rear edge 20 positioned along the perimeter of panel 12 extends substantially perpendicular from the rear face 16. As can be appreciated, front edge 18 and rear edge 20 can be a one-piece structure or two separate structures integrated with panel 12. In that regard, the entire label holder 10 may be integrally formed by a molding process as a single unitary piece. Although the label holder 10 is illustrated having a front edge 18 and a rear edge 20, in alternative embodiments, the front edge 18 and/or the rear edge 20 are not required.

Figure 2:
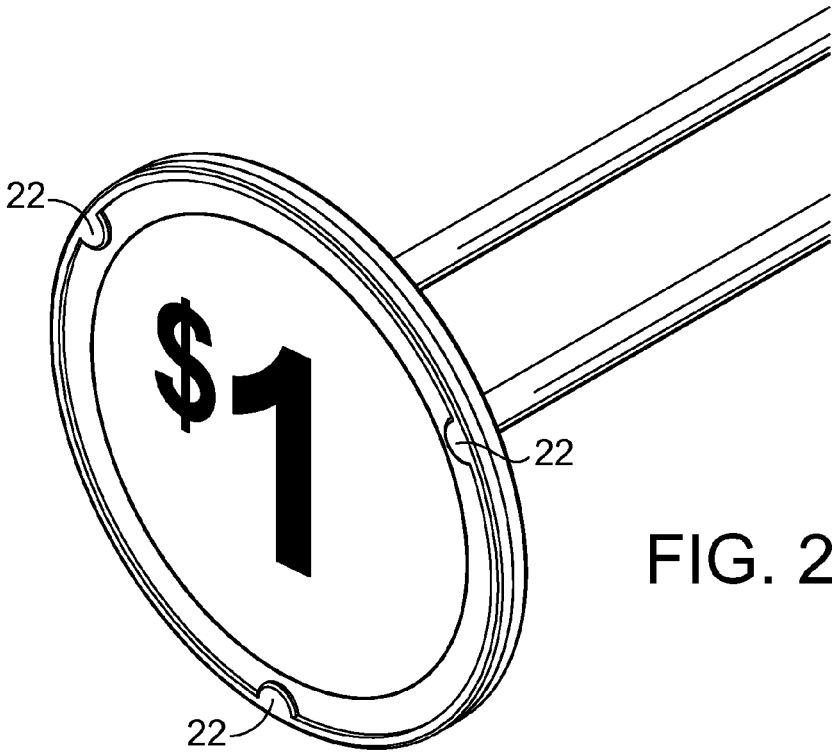

One or more label securing elements 22 are dispersed along the inner perimeter of the front edge 18, as illustrated in FIG. 1 (rear view) and FIG. 2 (front view). The label securing elements 22 are used to retain a label adjacent to the front face 14 of the label holder 10. In operation, outer portions of a label can be placed beneath label securing elements 22 to thereby hold the label in contact with the front face 14 of panel 12, as illustrated in FIG. 2. The label securing elements 22 extend inwardly from the interior wall of the front edge 18. The label securing elements 22 are raised above the front face 14 and are substantially parallel with panel 12. Although label securing elements 22 are illustrated as semi-circular in shape with the curve of the semi-circle positioned towards the interior of panel 12, the label securing elements 22 may be any size, shape, and/or orientation capable of securing a label to the front face 14 of the panel 12. Further, any number of label securing elements 22 can be used to enable the label holder to secure a label. As can be appreciated, in some cases, label securing elements 22 are not required to secure a label to the front face 14 of the label holder 10. For example, self-adhesive labels may be used to attach a label to the label holder 10. Alternatively, labels can be attached to the label holder 10 via tape, glue, hook and loop fasteners, or any other means capable of attaching a label to the front face of the label holder 10. The label securing elements work well for securing non-adhesive labels made of paper or paperboard material in the label holder 10.

Figure 5:
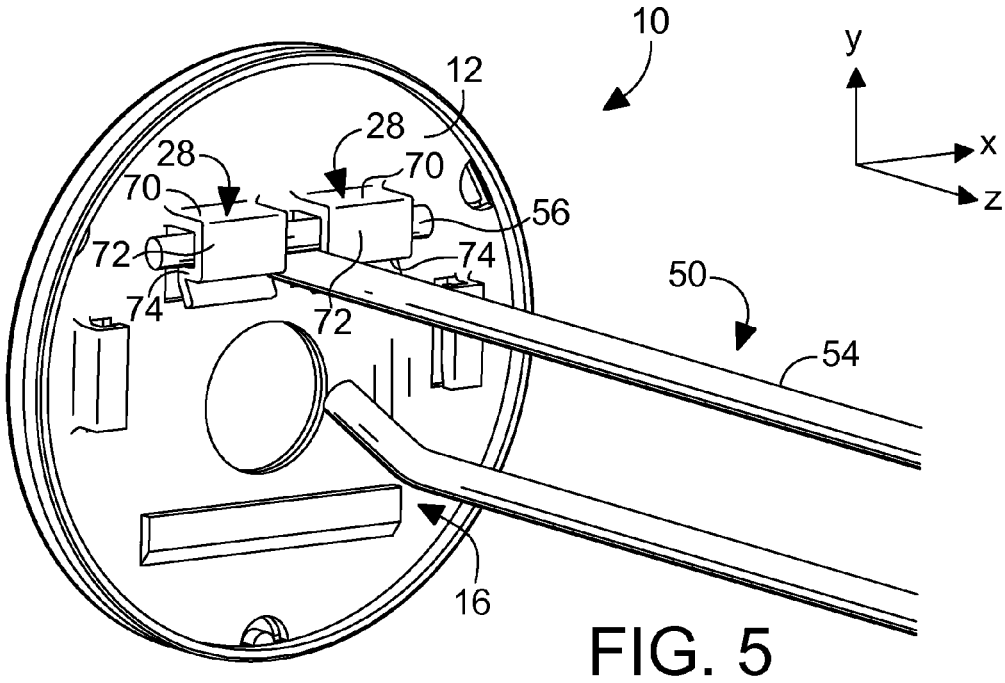

Though not necessary, the label holder 10 includes a plurality of label apertures 24 positioned along the edge of the panel 12. As illustrated in FIG. 1 (rear view) and FIG. 5 (front view), the label securing elements 22 are aligned with corresponding label apertures 24. The label apertures 24 of FIGS. 1 and 5 are approximately the same size and shape as the label securing elements 22 (i.e., semi-circular in shape with the curve of the semi-circle positioned towards the interior of panel 12). Such label apertures 24, however, may be any size, shape, and/or orientation. The label apertures 24 can be beneficial when the label holder 10 is formed via molding process as a single unitary piece. The label apertures 24 also provide access to the rear of a label held in place.

The label holder 10 can also include a removal aperture 26 (or a plurality of removal apertures 26). Removal aperture 26 enables a user to remove a label fastened or held adjacent to the front face 14 of the panel 12. In some embodiments, the removal aperture 26 is sized and/or shaped to accommodate a digit of a user (e.g., a finger). In implementation, a user digit is extended through the removal aperture 26, via the rear face 16 of the panel 12, to dislodge a label secured by the label securing elements 22. Alternatively, the removal aperture 26 can be sized and/or shaped to accommodate any other instrument used to dislodge a label from the label holder 10.

The label holder 10 also preferably includes one or more brackets 28, lateral securing elements 30, and/or a supporting element 32 to interchangeably secure, affix, or adjoin the label holder 10 to a cylindrical-crossbar display hook and/or a display plate display hook. In this regard, a label holder can be interchangeably coupled with or attached to a display hook having a cylindrical crossbar or a display plate.

Figure 3:
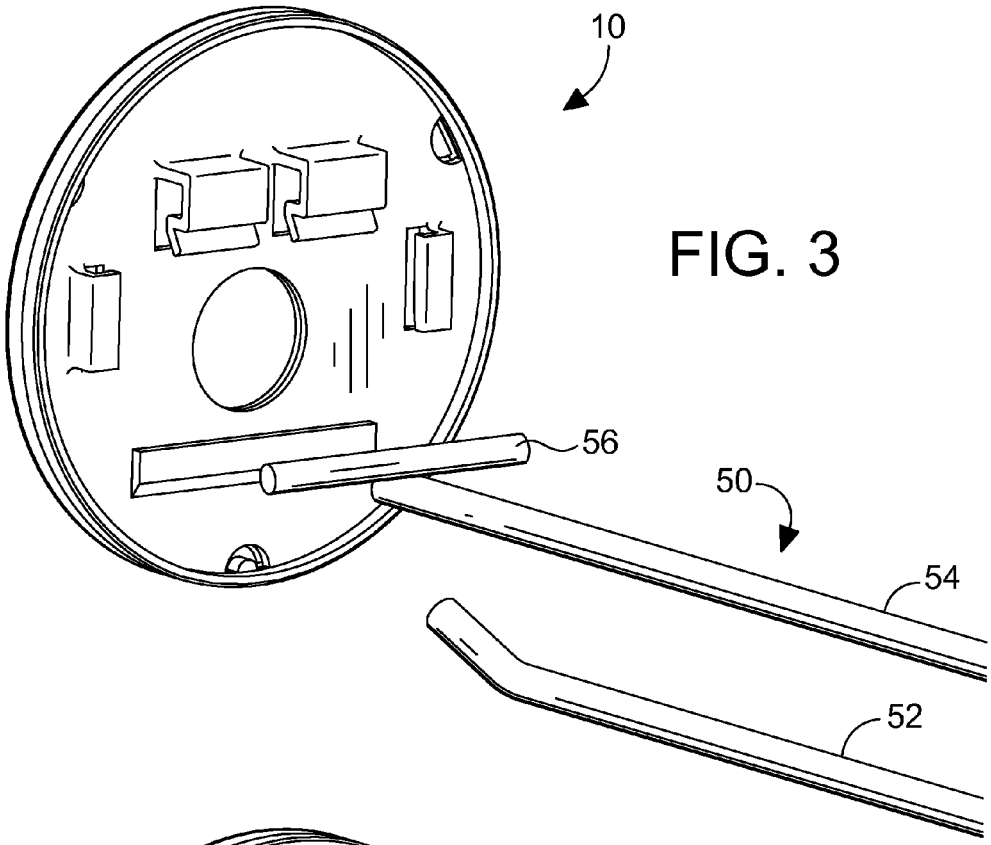

A cylindrical-crossbar display hook 50, as used herein, refers to a display hook that includes a crossbar of a generally cylindrical shape positioned at a distal end of, and generally perpendicular to, the label member for attaching a label holder 10. A cylindrical-crossbar display hook 50 is illustrated in FIG. 3. The cylindrical-crossbar display hook 50 includes a display member 52 and a label member 54 that extend from a base region (not shown) adaptable to mount to a fixture, a wall, a peg board, or other secure mounting structure (not shown). The display member 52 is a generally horizontal elongate prong that functions to support and display various products. By way of example only, one or more products can be suspended, either directly or indirectly, from the display member 52. The label member 54 functions to provide an area adjacent the displayed products for providing information about the products, such as by supporting a label holder on a cylindrical crossbar 56. The cylindrical crossbar 56 enables a label holder, such as interchangeable label holder 10, to be affixed to the cylindrical-crossbar display hook 50. The cylindrical crossbar 56 is substantially perpendicular to the label member 54. In this regard, when the cylindrical-crossbar display hook 50 is mounted (e.g., to a display fixture), the label member 54 is substantially perpendicular to the mounting structure and the cylindrical crossbar is substantially parallel to the mounting structure. Stated differently, when the cylindrical-crossbar display hook 50 is in use, the label member 54 and the cylindrical crossbar 56 are positioned substantially parallel to the ground and substantially perpendicular relative to one another. In one embodiment, the cylindrical crossbar 56 is securely attached to a top portion of the circumference of the label member 54. Cylindrical crossbar 56 can, in some cases, enable a label holder, such as label holder 10, to be pivotably adjoined to a cylindrical-crossbar display hook 50. In such cases, the label holder can be rotated or flipped about the cylindrical crossbar 56.

Figure 7:
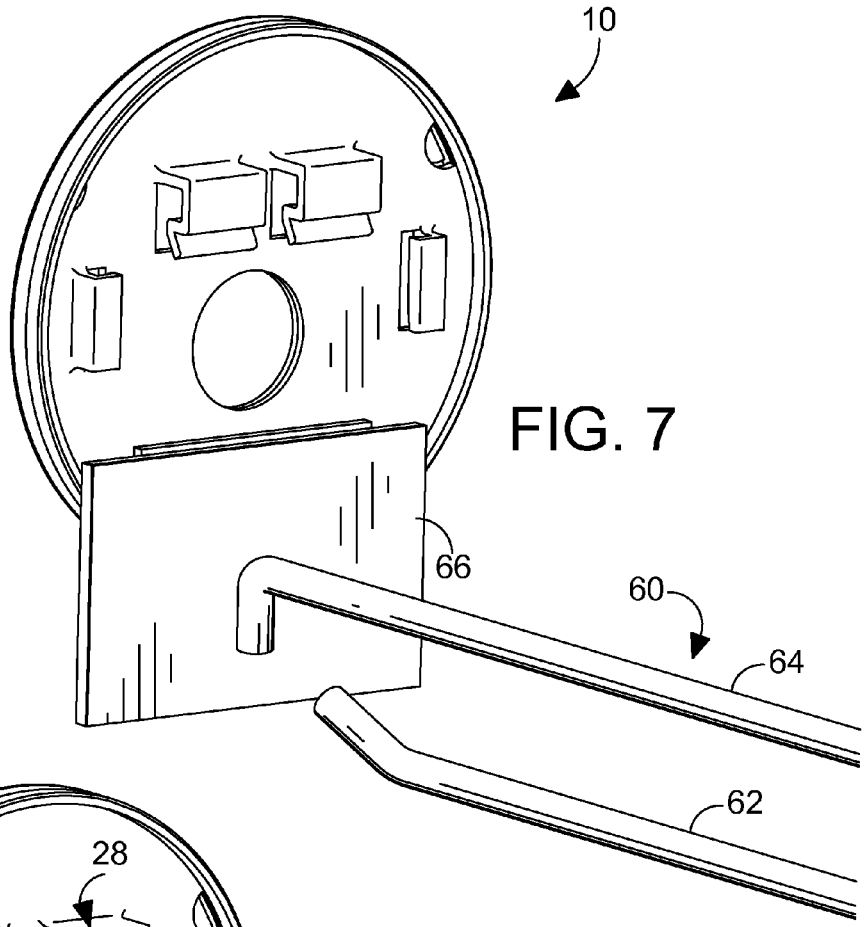

A display plate display hook, as used herein, refers to a display hook that includes a substantially planar plate positioned at the distal end of the label member for attaching a label holder. With reference to FIG. 7, a display plate display hook 60 is illustrated. The display plate display hook 60 includes a display member 62 and a label member 64 that extend from a base region (not shown) adaptable to mount to a fixture, a wall, a peg board, a slatwall, or other secure mounting structure (not shown). The display member 62 functions to permit the display of various products, such as display member 52. In this regard, one or more products can be coupled to, either directly or indirectly, to the display member 62. The label member 64 functions just as the label member 54 and can support a label holder via a display plate 66. The display plate 66 enables a label holder, such as interchangeable label holder 10, to be affixed to the display plate display hook 60. The display plate 66 is substantially perpendicular to a portion of the label member 64. That is, when the display plate hook 60 is mounted (e.g., to a fixture), the label member 64 is positioned substantially horizontal and the planar crossbar 66 is positioned substantially vertical.

Although illustrated as rectangular in shape, in other embodiments, the planar crossbar 66 can be other shapes, such as a square, a circle, etc.

While the cylindrical-crossbar display hook 50 of FIG. 3 and the display plate display hook 60 of FIG. 7 illustrate both a label member and a display member, as can be appreciated, such display hooks might have a single member that functions to display products as well as support a label holder. Alternatively, cylindrical crossbar display hook 60 and/or display plate display hook 50 may include multiple members, such as a plurality of display members for displaying products.

Returning to FIG. 1, one or more brackets 28 are configured to enable the label holder 10 to be interchanged between display plate display hooks and cylindrical-crossbar display hooks. In one embodiment, two brackets 28 (i.e., a right bracket and a left bracket) are utilized to secure a label holder 10 to display plate display hooks and cylindrical-crossbar display hooks. In FIG. 1, the two brackets 28 are discontinuous, but adjacent to one another. The gap or space between the two brackets 28 is sufficient to allow the label member 54 of the cylindrical-crossbar display hook 50 to extend perpendicular from the rear face 16 of panel 12, as illustrated in FIG. 5. The positioning of the label member 54 between the right and left brackets 28 prevents lateral movement (i.e., side-to-side movement or movement along the x-axis) of the label holder relative to a cylindrical-crossbar display hook. In embodiments, the brackets 28 extend from the rear face 14 of panel 12. As illustrated in FIG. 1, the brackets 28 are positioned above a horizontal midline 68 of the label holder 10.

To enable interchangeable label holder 10 to adjoin with either a display plate display hook or a cylindrical-crossbar display hook, brackets 28 are structured to receive both types of display hooks. Turning now to FIG. 5, the brackets 28 act as fasteners suitable for engaging a cylindrical crossbar of a cylindrical-crossbar display hook. As can be appreciated, the brackets 28 include an interior region that, upon reception of the cylindrical-crossbar display hook 50, confines the cylindrical crossbar 56, as shown in FIG. 5. As illustrated, the cylindrical crossbar 56 is secured via top portions 70, side portions 72, and bottom portions 74 of the brackets 28. The top portions 70, side portions 72, bottom portions 74 along with panel 12 substantially enclose the cylindrical crossbar 56 and prevent movement of the label holder along the y-axis (vertical movement or up-and-down movement) and along the z-axis (front-to-back movement or movement along the axis defined by the label member 54). As noted above, lateral movement (or movement along the x-axis) of label holder 10 is restricted based on the perpendicular extension of the label member 54 of the display hook from between the right and left brackets 28.

Figure 4:
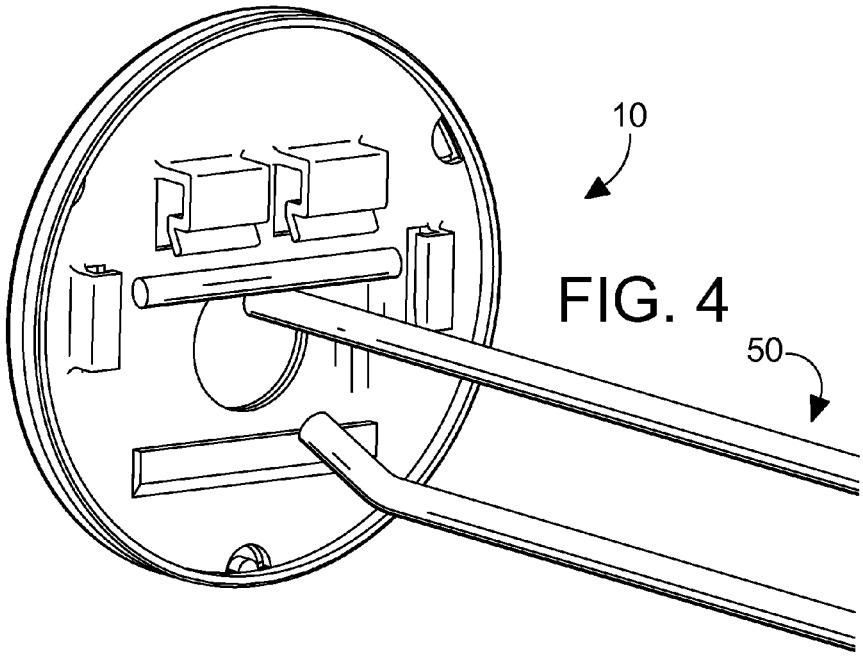
Figure 6:
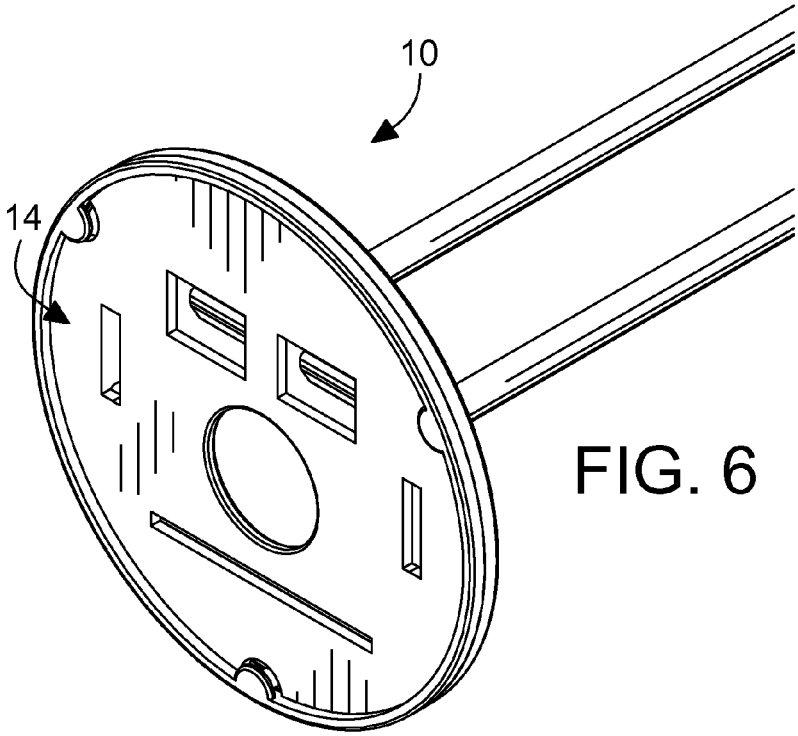

By way of example only, FIGS. 3-6 illustrate affixing the label holder 10 to the cylindrical-crossbar display hook 50. FIGS. 3 and 4 show the label holder 10 approaching the brackets 28 of the cylindrical-crossbar display hook 50. In FIG. 5, the label holder 10 is fastened to the cylindrical crossbar 56 by inserting the cylindrical crossbar 56 into the interior of the brackets 28 via the openings on the bottom of the brackets 28. As shown in FIG. 5, the label holder 10 is secured to the hook 50 and restricted from movement along the x-axis, the y-axis, and the z-axis. Because the brackets 28 are positioned above the midline 68, gravity causes the bottom of the label holder 10 hang down below the crossbar 56 and position the label holder 10 in a vertical orientation. FIG. 6 displays a front view of the label holder 10 attached to the cylindrical display hook 50.

Figure 9:
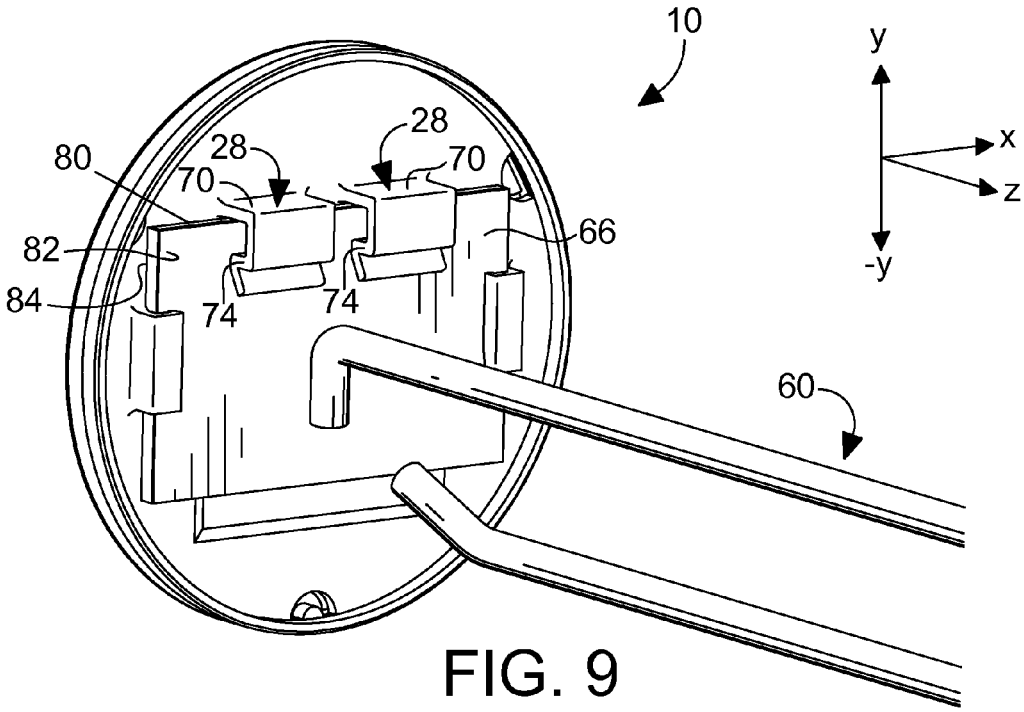

As previously discussed, the label holder 10 is also suitable for fastening to a display plate display hook. As shown in FIG. 9, the brackets 28 receive the display plate 66 and at least partially confine the display plate 66 of the display plate display hook 60. The display plate 66 is secured via the top and bottom portions 70, 74 of the brackets 28. The top portions 70, the bottom portions 74 (via the edges of the bottom portions 74), and panel 12 are configured to confine, contract, and/or exert pressure on the top 80, rear 82, and front 84 portions of the display plate 66, respectively. Accordingly, such top portions 70, bottom portions 74, and panel 12 prevent movement of the label holder 10 along the z-axis (front-to-back movement) and the negative direction of the y-axis (downward vertical movement). As can be appreciated, in some embodiments, edges of bottom portions 74 of brackets 28 can exert a predetermined amount of tension that secures the label holder 10 to the crossbar of the display plate display hook 60. In other embodiments, bottom portions 74 of brackets 28 confine the planar crossbar from moving along the z-axis, but do not independently secure movement of label holder 10 in the other directions (i.e., in the x and y-axis directions).

With reference back to FIG. 1, to secure the label holder 10 to the crossbar of a display plate display hook 60 such that the label holder 10 is restricted from lateral movement (i.e., along the x-axis or side-to-side movement) and/or restricted from upward vertical movement (i.e., in the positive direction of the y-axis), the label holder 10 can also include one or more lateral securing elements 30 and/or one or more supporting elements 32. The lateral securing elements 30 function as to laterally secure the label holder 10 to a display plate of a display plate crossbar display hook 60. That is, lateral securing elements 30 restrict label holder 10 from lateral movement relative to the display hook 60. Lateral securing elements 30 are perpendicularly oriented to the horizontal midline 68 of the label holder 10. Lateral securing elements 30 are configured to receive lateral edges of the display plate. Accordingly, a right lateral securing element 30 receives the right lateral edge of the display plate, and the left lateral securing element 30 receives the left lateral edge of the display plate, as shown in FIG. 9. In embodiments, the lateral securing elements 30 are L-shaped and appropriately sized to receive lateral edges of the planar-shaped crossbar. Lateral securing elements 30 extend from the rear face 14 of the panel 12. As illustrated in FIG. 1, the lateral securing elements 30 are positioned proximate to the horizontal midline 68 of the label holder 10.

Figure 10:
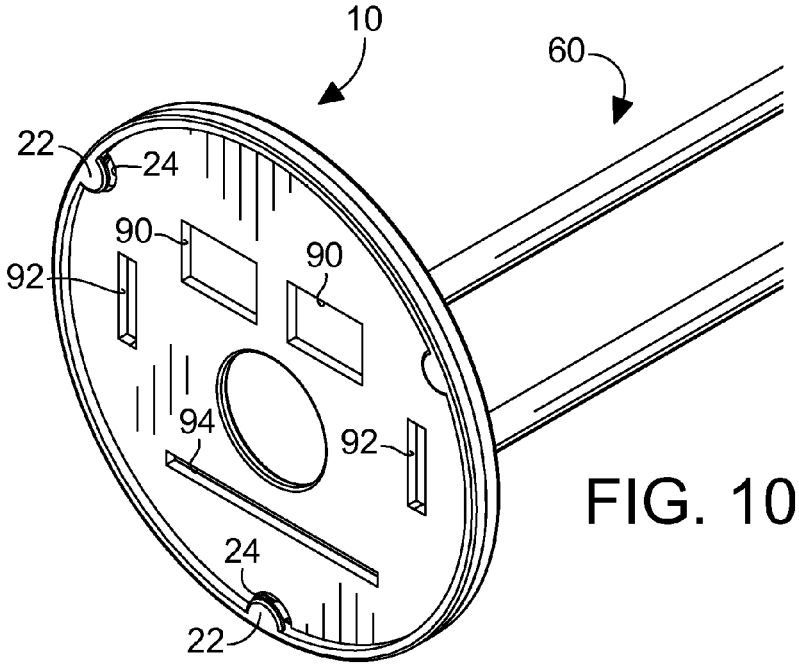

The supporting element 32 functions as to vertically secure (i.e., along the positive direction of the y-axis) the label holder 10 to the display plate of the display plate display hook 60. Supporting element 32 extends from the rear face 14 of the panel 12. As illustrated in FIG. 1, the supporting element 32 is positioned below the horizontal midline 68 of the label holder 10. Though not necessary, bracket apertures 90, securing element apertures 92, and support aperture 94 can be aligned with the corresponding brackets 28, lateral securing elements 30, and supporting element 32, as illustrated in FIGS. 1 and 10. In some cases, such apertures are approximately the same size and/or shape of the corresponding component and align therewith to assist in the molding process.

Figure 8:
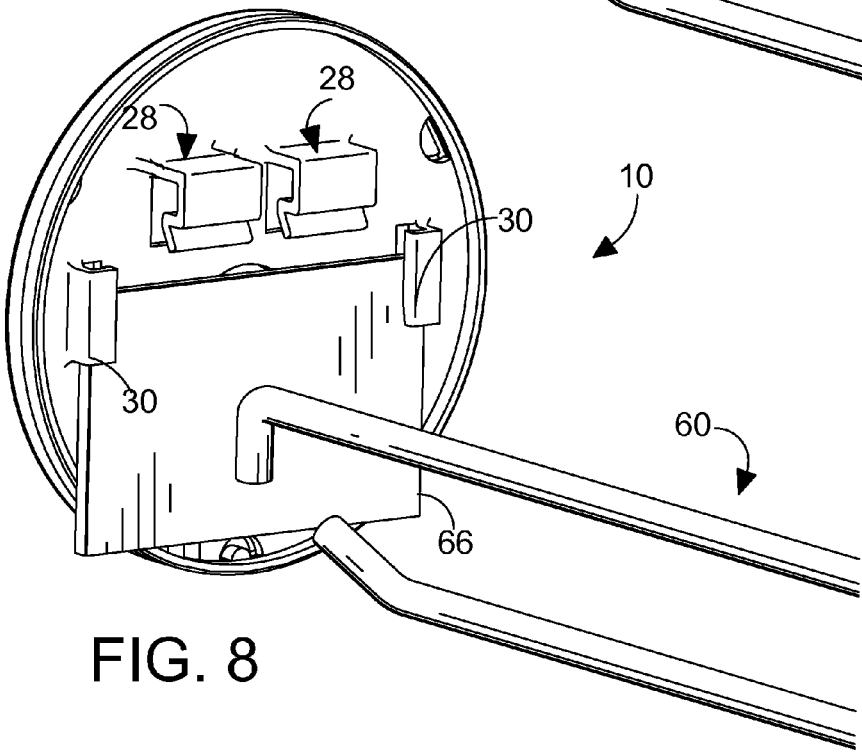

By way of example only, FIGS. 7-10 illustrate affixing the label holder 10 to the display plate display hook 60. FIG. 7 shows the label holder 10 approaching the display plate display hook 60. In FIG. 8, the securing elements 30 are in contact with the lateral edges of the display plate 66 as the brackets 28 are being directed towards the top edge of the display plate 66. Accordingly, the display plate 66 is fastened to the label holder 10 by inserting the display plate 66 in the interior of the brackets 28 via the securing elements 30. As shown in FIG. 9, the label holder 10 is secured between the brackets 28, the securing elements 30, and the supporting element 32. As such, the label holder 10 is restricted from movement along the x, y, and z-axis. FIG. 10 displays a front view of the label holder 10 attached to the display plate display hook 60.

Returning to FIG. 1, the brackets 28 may also include extension portions 76 that extend from the bottom portions 74 of the brackets 28 (e.g., at an approximately 45 degree angle). The extension portions 76 are configured to enable the bottom portions 74 of brackets 28 to extend or move away from rear face 16 of panel 12 (e.g., via user engagement or crossbar engagement of the extension portions 76). Accordingly, a crossbar, such as a display plate or a cylindrical crossbar, can be more easily positioned within the interior portions of the brackets 28 and thereby adjoined with the label holder 10.

Many variations can be made to the illustrated embodiments of the present invention without departing from the scope of the present invention. Such modifications are within the scope of the present invention. For example, although discussed herein as a cylindrical crossbar of a cylindrical-crossbar display hook, the crossbar might be any non-planar shape. In this regard, the label holder is interchangeable between a display hook having a planar or plate-shaped crossbar and a display hook having a non-planar or plate-shaped crossbar. In other embodiments, a label holder can be interchangeable between display hooks having varying substantially planar-shaped crossbars. For instance, a label holder can be adaptable to affix to a crossbar comprising a plate of a first height, width, and/or depth (e.g., a height similar to height of crossbar 66 of FIG. 7) as well as a crossbar comprising a plate of a second height, width, and/or depth (e.g., a height similar to the height of the cylindrical crossbar 56 of FIG. 3). Further, while the present invention has been described in connection with the display of products and product labels, the present invention is not limited to such a narrow use. The display hooks and label holders can be used for various purposes, such as, for example, for organizing home and/or business items.

Other variations that are within the scope of the present invention include the use of a single bracket (similar to bracket 28) with a cut out in the middle to accommodate the portion of the label member 54 adjacent the cross member 56, as well as use of the label holder with a label member that terminates in an L-shaped cross member (as opposed to the T-shaped arrangement depicted in FIGS. 3 and 4). In this arrangement, the distal end of the label member would include a right angle bend. The perpendicular end portion would then be received in at least one of the brackets 28.

From the foregoing it will be seen that embodiments of this invention are well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A restricted lateral-movement label holder affixable to a display hook having a crossbar perpendicular to a label member, the label holder adapted for being affixed to both a cylindrical-shaped crossbar and a display plate crossbar, the label holder comprising:

a substantially planar panel having a front face and a rear face, the front face adapted for displaying a label;

one or more brackets located above a horizontal mid-line of the label holder, the one or more brackets adapted for selectively alternately receiving the cylindrical-shaped crossbar, wherein the perpendicular label member of the display hook is positioned to engage the one or more brackets to restrict lateral movement of the label holder, and the display plate crossbar; and a set of securing elements comprising a first securing element and a second securing element oriented perpendicularly to the horizontal mid-line of the label holder for receiving lateral edges of the display plate crossbar to restrict lateral movement of the label holder.

2. The label holder of claim 1 further comprising a support element located below the horizontal mid-line of the label holder to restrict vertical movement of the label holder.

3. The label holder of claim 1, wherein the one or more brackets are a set of discontinuous brackets including a first bracket and a second bracket that are adapted to receive the display plate crossbar.

4. The label holder of claim 3, wherein the first bracket and the second bracket secure the label holder to the display plate crossbar such that movement of the label holder in the vertical direction and the front-to-back direction is prevented.

5. The label holder of claim 3, wherein the first bracket and the second bracket exert a predetermined pressure on a rear side of the display plate crossbar.

6. The label holder of claim 3, wherein each of the first bracket and the second bracket include an extension portion accessible by a user digit or a crossbar to extend the bracket away from the rear face of the substantially planar panel.

7. The label holder of claim 1, wherein the first securing element and the second securing element are L-shaped and sized to accommodate the lateral edges of the display plate crossbar.

8. A label holder for interchangeably adjoining to a display hook having a non-planar crossbar and a display hook having a planar crossbar, the label holder comprising:

a substantially planar panel having a front face and a rear face, the front face adaptable for displaying a label;

a pair of brackets comprising a first bracket and a second bracket located above a horizontal mid-line of the label holder, the first and second brackets adapted for alternately receiving the non-planar crossbar and for receiving the planar crossbar; and a pair of securing elements comprising a first securing element and a second securing element functional for receiving lateral edges of the planar crossbar to restrict lateral movement of the label holder.

9. The label holder of claim 8, further comprising a support element located below the horizontal mid-line of the label holder to restrict vertical movement of the label holder.

10. The label holder of claim 8, wherein the first and second brackets are aligned horizontally and are spaced apart a sufficient distance to receive a member perpendicular to the non-planar crossbar which prevents lateral movement of the label holder when adjoined to the non-planar crossbar based on the position of the member between the first bracket and the second bracket.

11. The label holder of claim 8, wherein the non-planar crossbar is cylindrically shaped and the brackets are configured to receive the crossbar.

12. The label holder of claim 8, wherein the first bracket and the second bracket accommodate the non-planar crossbar having a first depth and the planar crossbar having a second depth, the first depth being different from the second depth.

13. The label holder of claim 8, wherein the first bracket and the second bracket accommodate the non-planar crossbar having a first height and the planar crossbar having a second height, the first height being different from the second height.

14. The label holder of claim 8, wherein the first securing element and the second securing element are L-shaped and sized to accommodate the lateral edges of the planar crossbar.

15. The label holder of claim 8, wherein each of the first bracket and the second bracket include an extension portion accessible by a user digit and a crossbar to extend the corresponding bracket away from the rear face of the substantially planar panel.

16. A label holder for securing and removing a label, the label holder comprising:

a substantially planar panel having a front face and a rear face, the front face having a front edge extending substantially perpendicular from the front face, the front edge having an inner perimeter;

a set of label securing elements dispersed along the inner perimeter of the front edge, each of the label securing elements being substantially parallel with the substantially planar panel and extending inwardly from the front edge, the set of label securing elements securing the label to the front face of the substantially planar panel;

a removal aperture positioned in the planar panel and sized to accommodate a label removing component to be inserted through the removal aperture to remove the label;

a pair of brackets comprising a first bracket and a second bracket located above a horizontal mid-line of the label holder, the first and second brackets adapted for alternately receiving the non-planar crossbar and for receiving the planar crossbar; and a pair of securing elements comprising a first securing element and a second securing element functional for receiving lateral edges of the planar crossbar to restrict lateral movement of the label holder.

17. The label holder of claim 16, wherein the removal aperture is circularly shaped.

18. The label holder of claim 16, wherein the removal aperture is positioned at approximately a center of the substantially planar panel.

19. The label holder of claim 16, wherein the removal aperture is sized and shaped to accommodate a user digit.

20. The label holder of claim 19, wherein the label is positioned between the set of label securing elements and the front face of the substantially planar panel.

* * * * *